United States Patent [19]

Wilcox

[11] Patent Number: 4,624,097

[45] Date of Patent: Nov. 25, 1986

[54] ROPE

[75] Inventor: Robert J. Wilcox, Ancaster, Canada

[73] Assignee: Greening Donald Co. Ltd., Hamilton, Canada

[21] Appl. No.: 714,323

[22] Filed: Mar. 21, 1985

[30] Foreign Application Priority Data

Mar. 23, 1984 [CA] Canada ..... 450373

[51] Int. Cl.[4] ..... D02G 3/36; D07B 1/16; D07B 7/14

[52] U.S. Cl. ..... 57/232; 57/231; 57/241; 57/250; 57/258; 57/296

[58] Field of Search ..... 57/200, 222, 223, 231, 57/232, 240, 241, 243, 249, 250, 258, 295, 296, 297

[56] References Cited

U.S. PATENT DOCUMENTS

| | | | |
|---|---|---|---|
| 3,911,785 | 10/1975 | Hood | 57/234 X |
| 4,022,010 | 5/1977 | Gladenbeck | 57/231 |
| 4,050,230 | 9/1977 | Senoo et al. | 57/231 |
| 4,059,951 | 11/1977 | Roe | 57/234 X |
| 4,159,618 | 7/1979 | Sokaris | 57/249 X |

*Primary Examiner*—Donald Watkins
*Attorney, Agent, or Firm*—Hirons, Rogers & Scott

[57] ABSTRACT

The invention provides a rope having a central strand and a plurality of outer strands extending helically about the central strand. Each of the outer strands consists of a plurality of elements in a helical wrap, at least some of these elements having a core of synthetic plastic filaments extending generally in parallel with one another and a sheath about the core containing the filaments. The invention also provides a method of making the rope.

11 Claims, 1 Drawing Figure

ROPE

Figure 1:
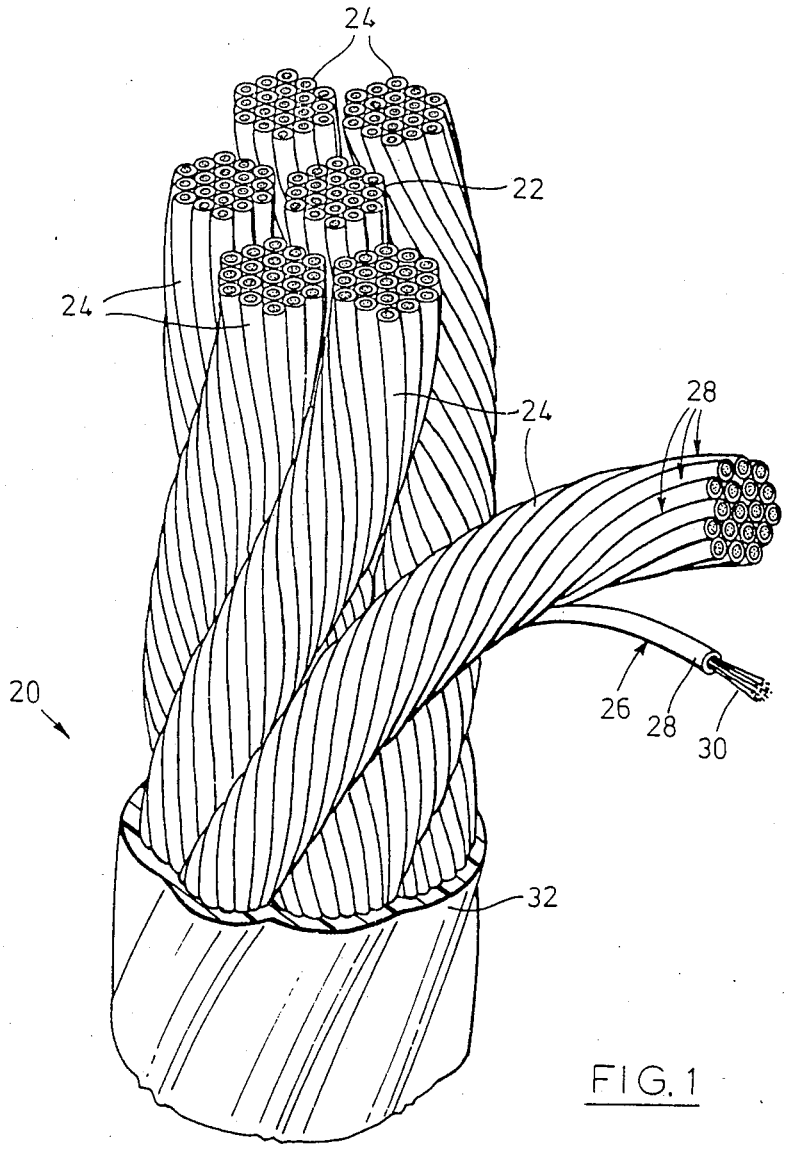

This application relates to ropes and to a method of manufacturing ropes, and more particularly to a rope made entirely of synthetic plastic materials.

Ropes are used in environments where it is desirable to transmit high tensile forces to move such things as elevator cars, elements of cranes, drag lines and the like. The desirable characteristics of ropes are conflicting. It is desirable that the rope be light and yet strong, flexible and yet have long life. Also most ropes are used in environments where deterioration due to water or corrosive chemicals is common.

Most ropes accepted in the marketplace are made from ferrous wires which are first combined in a helical wrap with other wires to make strands and then these strands are wrapped helically about a central strand to produce the rope. Such ropes are very strong but also quite heavy and of limited flexibility. Attempts have been made to improve their resistance to corrosion by coating them in synthetic plastic materials or by impregnating between the strands with the same plastic materials. Such solutions enhance the life of the rope but tend to reduce its flexibility and increase its weight.

Recently, manufacturers have turned to filaments of synthetic plastic materials to develop ropes made from such materials. It is well known that filaments of material such as that sold by E. I. DuPont De Nemours & Co. Inc. under the trade mark KEVLAR have great tensile strength but tend to wear quickly if they rub across one another. A suitable method of manufacturing rope from such filaments has proven elusive. Some manufacturers have bunched the fibres and then impregnated the resulting structure with synthetic plastic materials to lock the filaments in position. Although acceptable ropes have been produced in this way, they have not achieved the same acceptability as wire ropes. This of course is to some extent due to the fact that a great deal of equipment existed is available to make wire ropes and entirely new equipment would be required to manufacture synthetic plastic ropes using impregnation techniques.

It is an object of the present invention to provide a synthetic plastic rope which can be made using conventional rope making techniques and equipment. Also, it is an object of the invention to provide a rope having high strength to weight characteristics as well as good flexibility and resistance to deterioration in use.

According to one aspect of the invention, a rope is provided having a central strand and a plurality of outer strands extending helically about the central strand. Each of the outer strands consists of a plurality of elements in a helical wrap, some of these elements having a core of synthetic plastic filaments extending generally in parallel with one another, and a sheath about the core containing the filaments. In another of its aspects, the invention provides a method of making the rope.

These and other aspects of the invention will be better understood with reference to the following description taken in combination with the drawing in which:

FIG. 1 is a perspective view of a portion of rope according to the invention with one of the strands deflected out of alignment to show the construction of an individual element.

As seen in FIG. 1 a preferred embodiment of rope according to this invention is designated generally by the numeral 20. The rope consists of a central strand 22 surrounded by six outer strands 24. One of the outer strands is deflected out of its proper alignment in the rope to show element 26 which is typical of all of the elements forming the strands. Element 26 has an outer sheath 28 surrounding a core 30 made up of a bunch of KEVLAR aramid fibre filaments which are generally parallel to one another in the bunch. (KEVLAR is a registered trade mark of E. I. DuPont de Nemours & Co. Inc.)

The rope 20 is conventional in general form but for the structure of the individual elements 28. Each of these elements consists of the KEVLAR core surrounded by a sheath which is preferably of ZYTEL (a trade mark of E. I. DuPont de Nemours & Co. Inc. for nylon resin) and which is applied to the core in an extrusion process. Also, the rope is completed by passing it through an extruder to apply a jacket 32 which is preferably of HYTREL (a trade mark of E. I. DuPont de Nemours & Co. Inc. for a polyester elastomer).

The arrangement is such that individual filaments of the core 30 will transmit tensile load and remain in generally parallel arrangement without crossover contact with adjacent filaments. The crossover contacts are made by the sheaths 28 so that as the rope flexes, the sheaths will slide on one another. Consequently the material of these sheaths should be chosen to provide a minimum of abrasion resistance while sliding over one another and also to permit minor movements of the filaments inside the sheath with a minimum of wear against the sheath.

As mentioned, the preferred material for the sheath is sold under the trade mark ZYTEL but any other suitable synthetic plastic material which can be applied by extrusion would be acceptable. With regard to the jacket 32, this is provided to minimize abrasion resistance of the rope in use, but it also helps to ensure that this very flexible rope retains it shape when it is bent around small curves. Also, the jacket tends to prevent the rope rotating when it is in tension, an effect caused by the helical winding of the oter strands about the central strands 22. The jacket can be of any suitable material having similar characteristics to HYTREL and in general can be a polyurethane, a polyethylene or a polyester.

The manufacture of the rope is performed using existing wire rope making equipment once the individual elements have been prepared by forming the sheath 28 about the bunch of filaments 30. The necessary number of elements are fed through the wire rope making equipment to form strands and then the strands in turn are fed into the equipment which wraps the outer strands 24 helically about the central strand 22. Apart from the extrusion process, the manufacture to this point is done on conventional wire rope making equipment. Next, the semi-finished rope is fed through a further extruder to apply the jacket 32. It will be appreciated of course that in some instances the rope is useful without the jacket and for such uses, the last step would be omitted.

The resulting rope is light, easy to handle, resistant to breakdown caused by abrasion between elements of the rope, and resists attack in hostile environments. The strength of the rope is comparable to that of wire rope of similar size but is outstandingly different in flex and fatigue tests.

The following test results were obtained using three different control ropes as described. The rope according to the invention was made of KEVLAR fibres encased in ZYTEL sheaths within a HYTREL jacket. A fatty acid amide was used as a lubricant during manufacture so that this lubricant was present in the finished rope.

| ROPE | LOAD | SAFETY FACTOR | SHEAVE/ ROPE Ø RATIO | CYCLES FAILURE |
|---|---|---|---|---|
| 0.625 in Ø | 11,000 | 3 | 12 | 4,900 |
| wire rope | 5,500 | 6 | 12 | 15,000 |
| (Nom. UTS | 11,000 | 3 | 24 | 11,000 |
| 32,500 lbs.) | 5,500 | 6 | 24 | 33,000 |
| KEVLAR #1 | 11,000 | 3 | 12 | 230 |
| Standard Cordage | 5,500 | 6 | 12 | 1,300 |
| Rope Design | 11,000 | 3 | 24 | 3,700 |
| (Nom. UTS | 5,500 | 6 | 24 | 67,000 |
| 33,000 lbs.) | | | | |
| KEVLAR #2 | 11,000 | 3 | 12 | 72 |
| Braided Rope | 5,500 | 6 | 12 | 240 |
| (Nom. UTS | 11,000 | 3 | 24 | 400 |
| 33,000 lbs.) | 5,000 | 6 | 24 | 7,800 |
| Present Invention | 16,000 | 3 | 12 | 122 |
| Wire Rope Design | 8,000 | 6 | 12 | 1,500 |
| (Nom. UTS | 16,000 | 3 | 24 | 1,000 |
| 67,000 lbs.) | 8,000 | 6 | 24 | 104,000 |

It will be seen from these test results that with normal sheave/rope ratios (i.e. about 24) and a safety factor of 6, which is commonly used, the present invention shows a significantly improved ability to withstand cyclical flexing under load.

The tests also show poor results using a safety factor of 3. This is believed to be due to increased friction between individual fibres with resultant high wear rates. Similarly when the sheave/rope ratio is 12 the results are poor, again indicating increased wear caused by inter-filament friction.

As a result of such tests it has been found that there are parameters in designing rope of the present kind which must be met. As mentioned, the sheaths around the fibres are designed to minimize rubbing between fibres. Of course, if each sheath contains too many fibres, the rubbing between fibres in each sheath is increased. It has been found that there should be no more fibres in one sheath than the equivalent of 21000 denier. Preferably there would be 15000 denier and this is the weight of filaments used to obtain the test results. With this weight, and the accepted standards of a safety factor of about 6, and a sheave to rope diameter greater than 17 (preferably about 24), the present rope has outstanding physical properties. The rope is also light, durable in alien environments and flexible for positioning in equipment, etc.

Certain environments or uses may require a variety of materials. It has been found that such materials can be selected from a wide range of possibilities. For instance any suitable thermoplastic can be used for the sheath and the jacket and these include: polyethylene, polypropylene, fluoroplastics, thermoplastic polyester, thermoplastic elastomeric polyester, ethylene copolymers, polyurethane, vinyl polymers and copolymers.

Although a convenient lubricant used in the manufacture and beneficial in the finished product is the fatty acid amide mentioned earlier, other lubricants can be used including, alcohol esters, amide waxes, fatty acids, fatty alcohols, glycol esters, metallic esters, paraffin waxes, petroleum waxes, polyethylene waxes, amorphous polypropylene, PTFE waxes, wax esters and wax soaps.

It will also be evident that ropes could be made using combinations of different filaments and fillers within the sheaths. This would depend on the design criteria and such variations are of course within the scope of the present invention as described and claimed.

I claim:

1. A rope comprising:

a central strand;

a plurality of outer strands extending helically about the central strand; and the central and outer strands each comprising a plurality of elements wrapped helically, each of the elements having a core of synthetic plastic filaments of denier no greater than 21000 and extending generally in parallel with one another, and a sheath about the core containing the filaments.

2. A rope as claimed in claim 1 in which the filaments are of aramid fibres.

3. A rope as claimed in claim 1 in which the sheath is of a material selected from the group, polyurethane, polyethylene, and polyester.

4. A rope as claimed in claim 1 in which the sheath is of a nylon resin.

5. A rope as claimed in claim 1 and further comprising a jacket containing the strands.

6. A rope as claimed in claims 1 and further comprising a jacket containing the strands, the jacket being of a material selected from the group polyurethane, polyethylene and polyester.

7. A method of manufacturing a rope comrpising the steps:

grouping synthetic plastic filaments into bundles having a denier less than 21000;

passing each bundle through an extruder to coat the bundle with a synthetic plastic sheath to form elements;

feeding groups of the elements into a device to wrap the elements helically to form strands;

feeding groups of strands through a device to form the strands into a rope having a central strand and outer strands wrapped helically about the central strand.

8. A method as claimed in claim 7 in which the filaments are of aramid fibre.

9. A method as claimed in claim 7 in which the sheath is of a nylon resin.

10. In a rope comprising a central strand, outer strands wrapped helically about the central strand, and each of the strands being made up of helically-wrapped elements, the improvement in which the elements are made up of a core of synthetic plastic filaments having a denier of less than 21000 and a sheath extended about the filaments to contain the filaments and to protect the filaments from abrasion at crossovers with other elements.

11. Structure as claimed in claim 10 in which the filaments are of aramid fibres.

* * * * *